US005729866A

United States Patent [19]

Chg

[11] Patent Number: 5,729,866

[45] Date of Patent: Mar. 24, 1998

[54] RETRACTABLE HANDLE ASSEMBLY FOR A SUITCASE

[76] Inventor: Chang Chin Chg, No. 113, Lane 60, Kung-Chiao Street, Ta-Li City Taichung Hsein, Taiwan

[21] Appl. No.: 667,974

[22] Filed: Jun. 19, 1996

[51] Int. Cl.[6] ..... A45C 13/22

[52] U.S. Cl. ..... 16/115; 190/18 A; 190/115

[58] Field of Search ..... 190/115, 18 A; 16/115

[56] References Cited

U.S. PATENT DOCUMENTS

| | | | |
|---|---|---|---|
| 4,508,202 | 4/1985 | Siegert et al. | 16/115 X |
| 5,199,811 | 4/1993 | Huang . | |
| 5,367,743 | 11/1994 | Chang | 16/115 |
| 5,371,923 | 12/1994 | Chang | 16/115 |
| 5,431,428 | 7/1995 | Marchwiak et al. . | |
| 5,459,908 | 10/1995 | Chen | 16/115 |
| 5,500,981 | 3/1996 | Ho | 16/115 |
| 5,513,873 | 5/1996 | Chen | 16/115 X |
| 5,542,150 | 8/1996 | Tu | 16/115 |
| 5,584,097 | 12/1996 | Lu | 16/115 |
| 5,590,748 | 1/1997 | Chang | 190/115 X |

*Primary Examiner*—Allan N. Shoap
*Assistant Examiner*—Christopher J. McDonald

[57] ABSTRACT

A retractable handle assembly for a suitcase includes a handle with an actuating member. Each end of the actuating member is connected to an end of a rod which is received in an inner tube slidably received in an outer tube. The outer tube has an inner side with a plurality of protrusions extending radially therefrom so as to define a plurality of recesses. A first member disposed on the other end of the inner tube has a top from which a flexible plate depends. The plate has a block disposed at a distal end. The second end of the rod is connected to a second member. The second member pushes the block against the inner side of the outer tube. When the actuating member is lifted, it lifts the rod and frees the block. The inner tubes can then be lifted.

3 Claims, 6 Drawing Sheets

RETRACTABLE HANDLE ASSEMBLY FOR A SUITCASE

BACKGROUND OF THE INVENTION

1. Field of the Invention

The present invention relates to a retractable handle assembly and more particularly, to a retractable handle assembly disposed to a suitcase or the like.

2. Brief Description of the Prior Art

Generally, the travel cases are cumbersome, carrying them while walking will have to be very painstaking and inconvenience. Consequently, there needs a retractable handle assembly which can be extended from the suitcase to be pulled when moving and can be retracted into the suitcase when transported. There are many prior patents disclosing many kinds of retractable handles used in suitcases, such as disclosed in U.S. Pat. No. 5,431,428 and U.S. Pat. No. 5,199,811. However, these kinds of designs are deemed to be complicated and has a high manufacturing cost.

The present invention intends to provide a retractable handle assembly which has a simple structure and is easy to be maintained so as to mitigate and/or obviate the above-mentioned problems.

SUMMARY OF THE INVENTION

The present invention provides a retractable handle for a suitcase and includes a handle with an actuating device received therein, the actuating means having each one of two ends thereof connected to one end of a rod which is received in an inner tube slidably received in an outer tube. The inner tube is connected to the handle with one end thereof and the outer tube having an inner side with a plurality of protrusions extending radially therefrom so as to define a plurality of recesses between the protrusions. A first member is disposed to the other end of the inner tube and has a top from which a flexible plate extends downwardly therefrom which has a block disposed to a distal end thereof. The other end of the rod is connected to a second member via the top wherein the second member pushes the block to contact the inner side of the outer tube such that when the actuating means is actuated to lift the rod together with the second member upwardly, the inner tube can be lifted with the handle.

It is an object of the present invention to provide a retractable handle assembly for a suitcase and the assembly has a simple structure.

It is another object of the present invention to provide a retractable handle assembly which is operated by rotating the handle.

It is a further object of the present invention to provide a retractable handle assembly which is operated by grasping the handle and an actuating member disposed to an under side of the handle.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
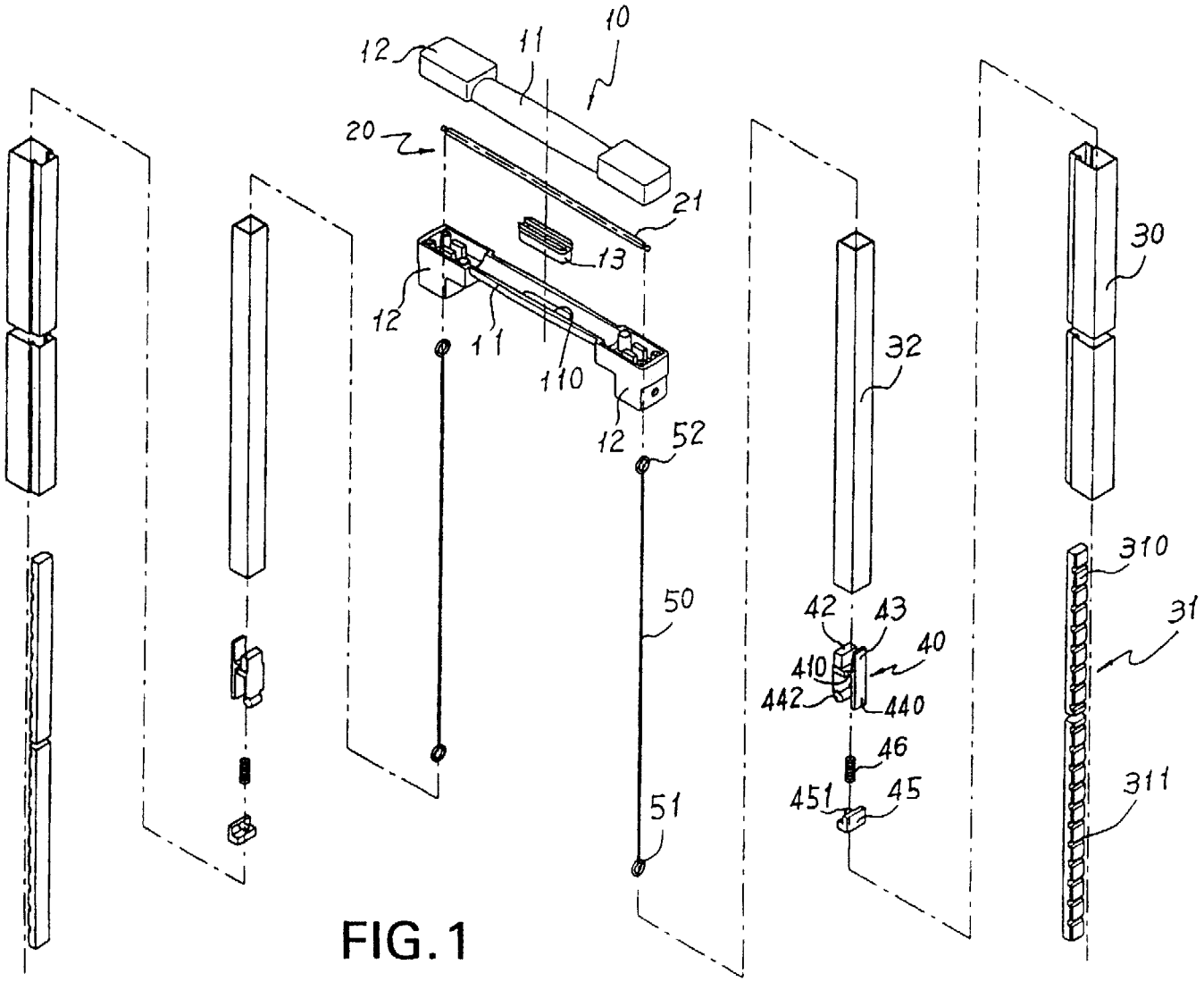
FIG. 1 is an exploded view of a retractable handle assembly in accordance with the present invention.
Figure 2:
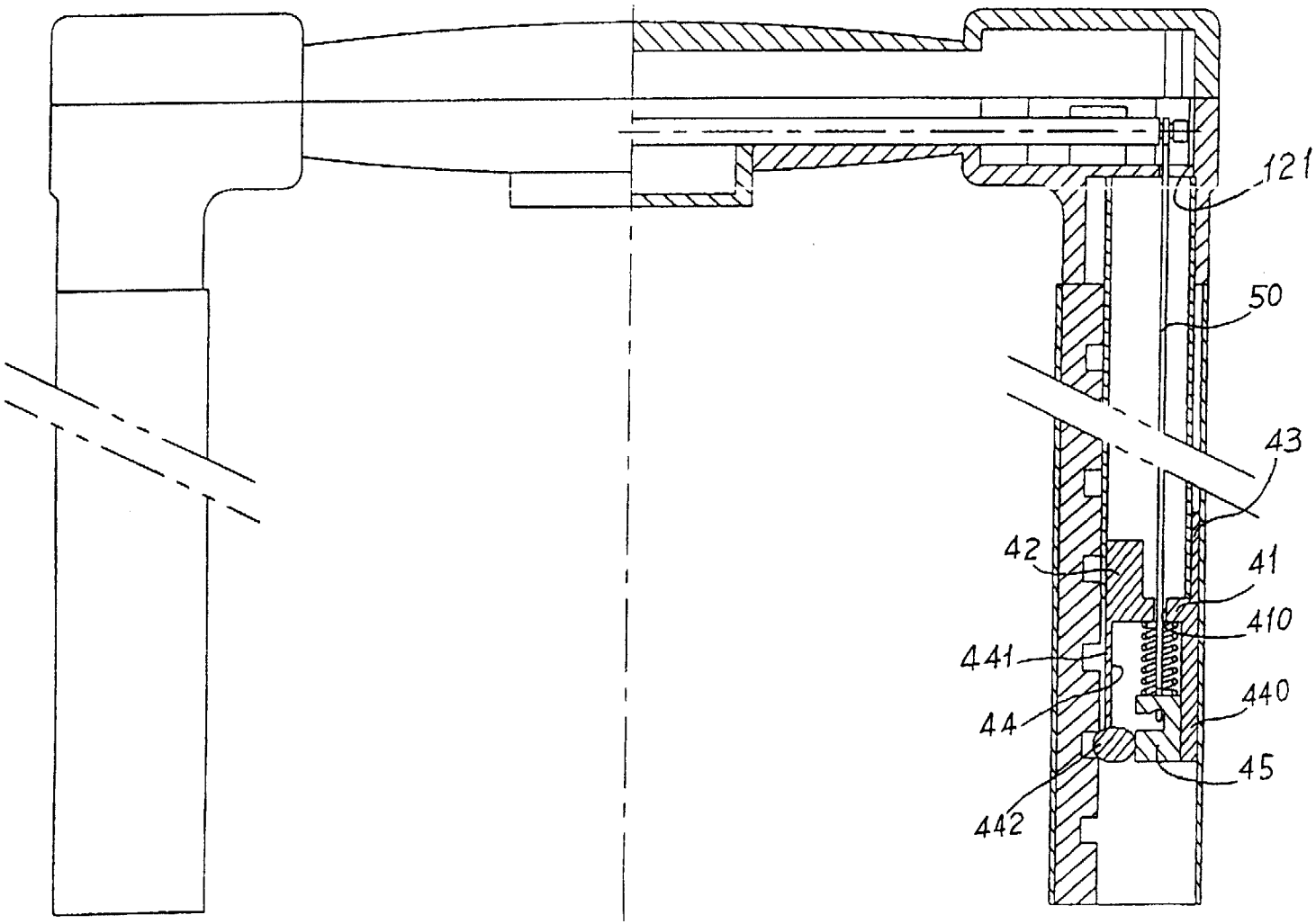
FIG. 2 is an elevational and illustrative view, partly in section, of the retractable handle assembly when in a locked position.
Figure 3:
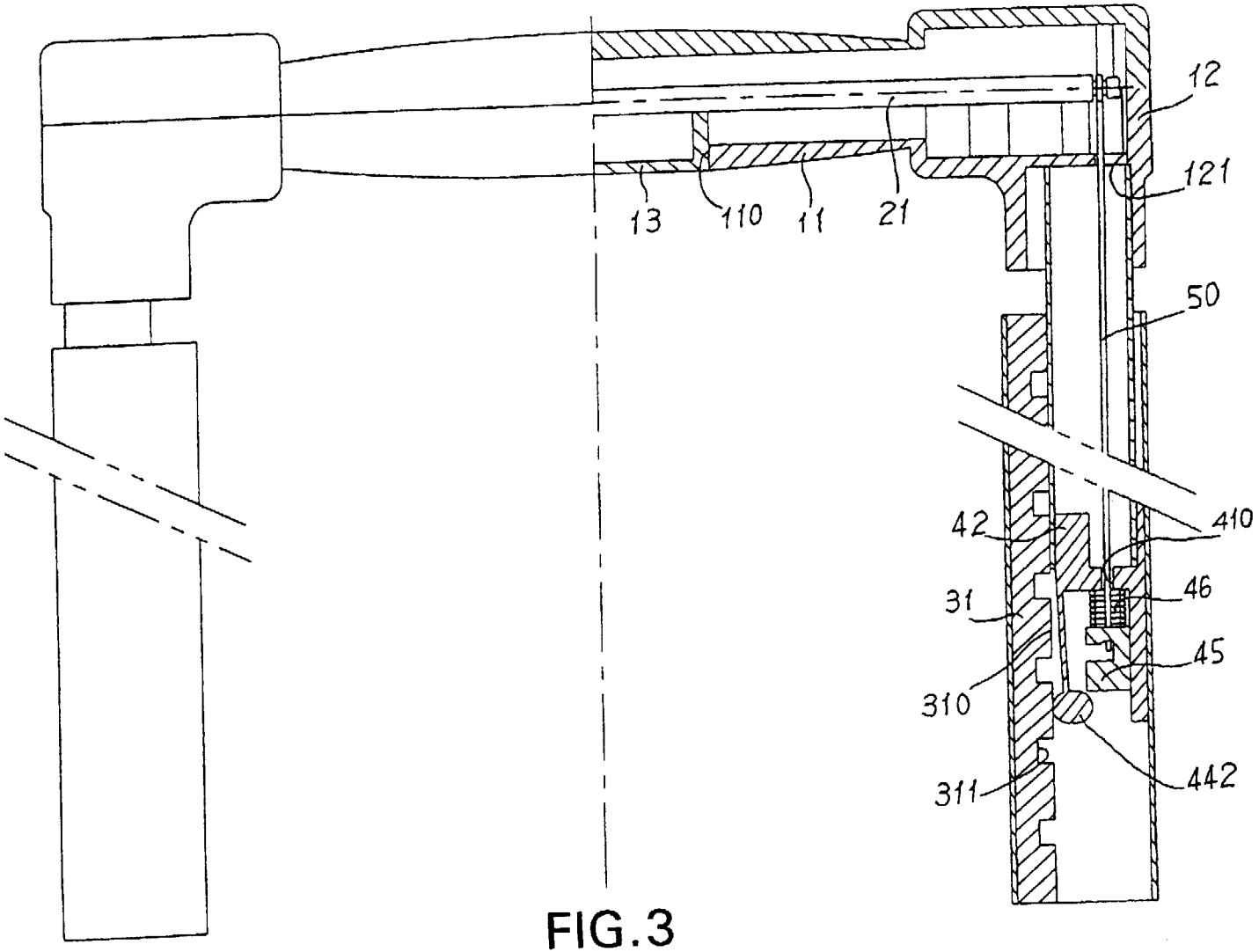
FIG. 3 is an elevational and illustrative view, partly in section, of the retractable handle assembly when in a unlocked position.

Referring to the drawings and initially to FIGS. 1 through 3, a retractable handle assembly in accordance with the present invention generally includes a handle 10 having a middle portion 11 and two end members 12, each of the end members 12 having a first hole 121 defined in an under side thereof. An actuating means 20 is disposed in the handle 10.

Two outer tubes 30 each of which disposes one end thereof to the corresponding end member 12 of the handle 10 and communicating with the first hole 121 corresponding thereto. Each of the outer tubes 30 has a rack element 31 received in an inner side thereof, the rack element 31 having a plurality of protrusions 310 protruding radially from an inner side thereof such that a plurality of recesses 311 are defined between any two adjacent protrusions 310 of the rack element 31.

Each of the outer tubes 30 has an inner tube 32 slidably received therein, each of the inner tubes 32 having one end thereof fixedly connected to the corresponding end member 12 of the handle 10 and the other end thereof fixedly connected to a first member 40. The first member 40 has a top 41 in which a second hole 410 is defined, two opposite plates 42, 43 extending upwardly from the top 40 and one of the side plates 43 received between the inner tube 32 and the outer tube 30 and the other side plate 42 received within the inner tube 32. A receiving recess 44 is defined in an under side of the first member 40 by the top 41, a side wall 440 and a flexible plate 441 adjacent to the inner side of the rack element 31 corresponding thereto. The flexible plate 441 has a block 442 connected to a distal end thereof.

Two rods 50 each have a first end and a second end, the first end thereof fixedly connected to the actuating means 20 in the handle 10 and the second end of the rod 50 extending through the second hole 410 of the top 41 corresponding thereto to fixedly connect to a second member 45 received in the receiving recess 44 of the first member 40 wherein a second loop 51 is formed to the second end of the rod 50 so as to securely mounted to a first stud 451 extending transversely from the second member 45. A spring 46 is mounted to the rod 50 and is disposed between the top 41 of the first member 40 and the second member 45 which is located adjacent to the block 442 and a distance is sized slightly smaller than that the total width of an combination of the second member 45 and the block 442 such that when in a locked position, the second member 45 pushes the block 442 to contact the rack element 31 and the block 442 is received in one of the recess 311, the inner tube 32 is therefore difficult to be pulled. When a user (not shown) operates the actuating means 20 to pull both of the rods 50 upwardly, the two second members 45 are lifted upwardly and do not contact the block 442 corresponding thereto as shown in FIG. 3, the block 442 then disengaged with the rack element 31 such that the handle 10 together with the inner tube 32, the first member 42, the rod 50 and the second member 45 can be pulled upwardly till the user releases the handle 10 and the actuating means 20 to let the second member 45 again pushes the block 442 received in the recess 311 corresponding thereto.

The actuating means 20 includes a link 21 received in the handle 20 and the link 21 has two ends and each of the ends is securely received in a first loop 52 formed to the first end of the rod 50 corresponding thereto. The handle 10 has a slot 110 defined in an under side of the middle portion 11 thereof so as to receive an actuating member 13 which contacts the link 21 such that the link 21 is lifted upwardly by grasping the handle 10 and the actuating member 13 as shown in FIG. 3.

Figure 4:
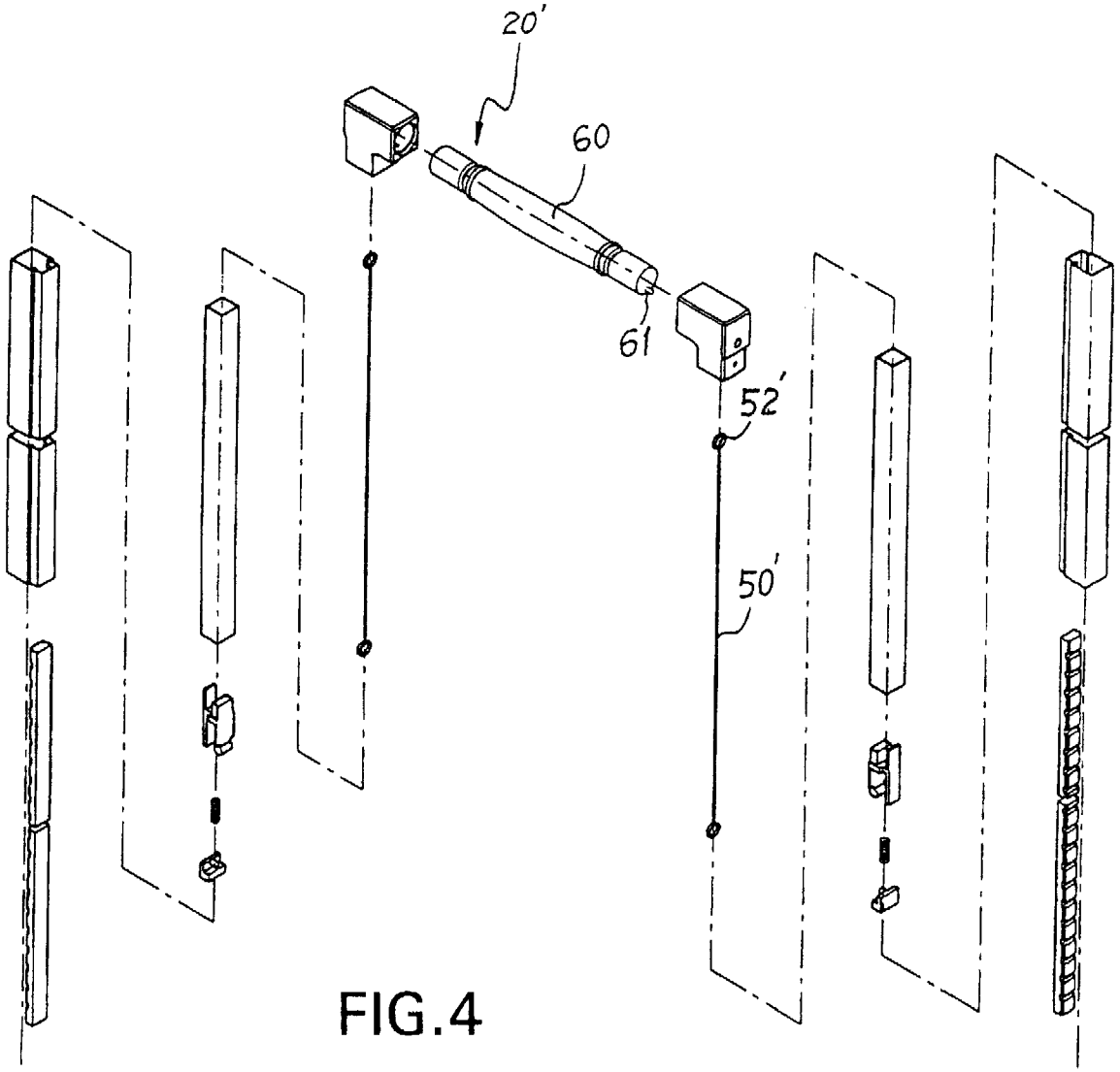
FIG. 4 is an exploded view of an embodiment of the retractable handle assembly in accordance with the present invention.
Figure 5:
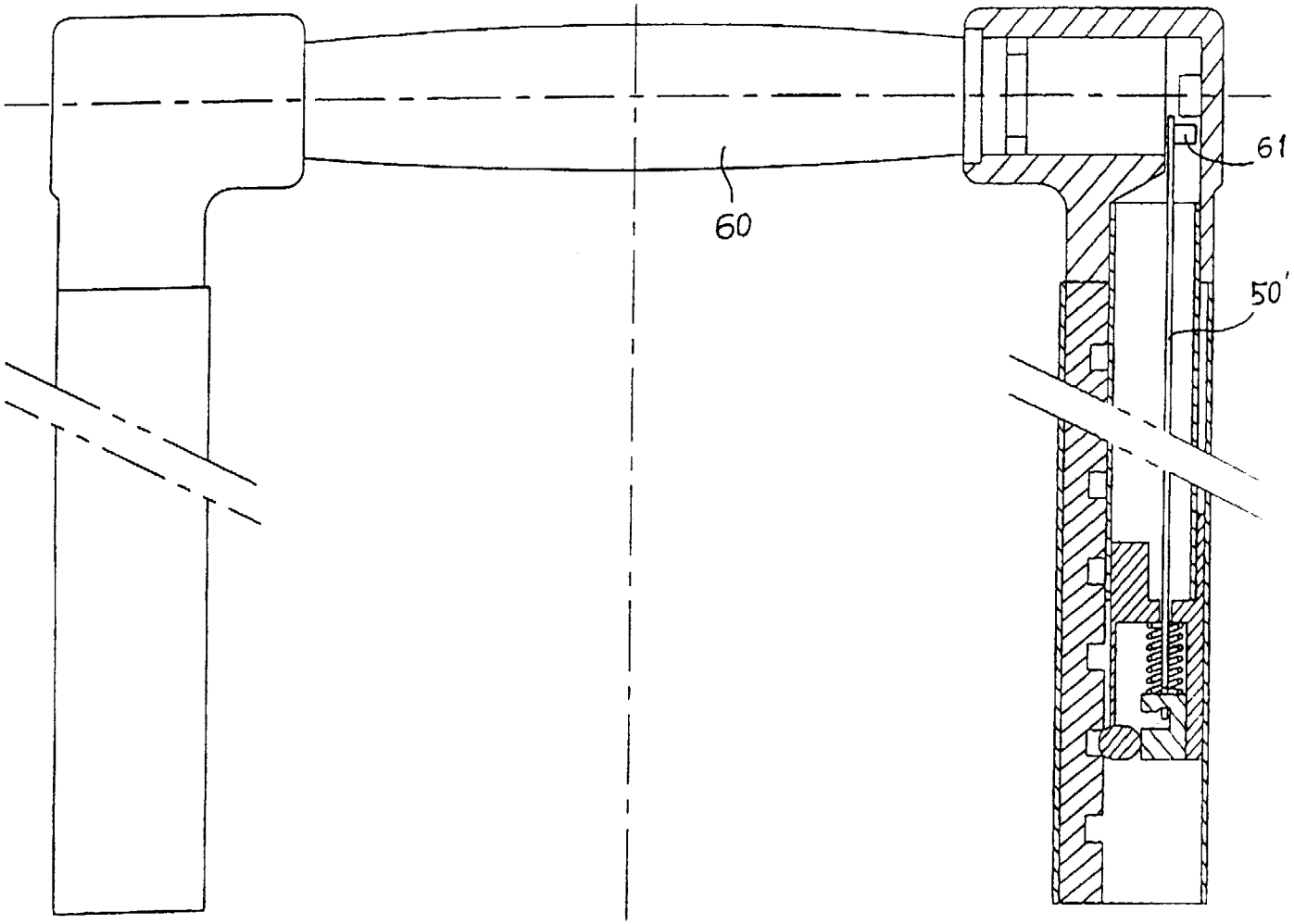
FIG. 5 is an elevational and illustrative view, partly in sections of the retractable handle assembly of the embodiment when in a locked position.
Figure 6:
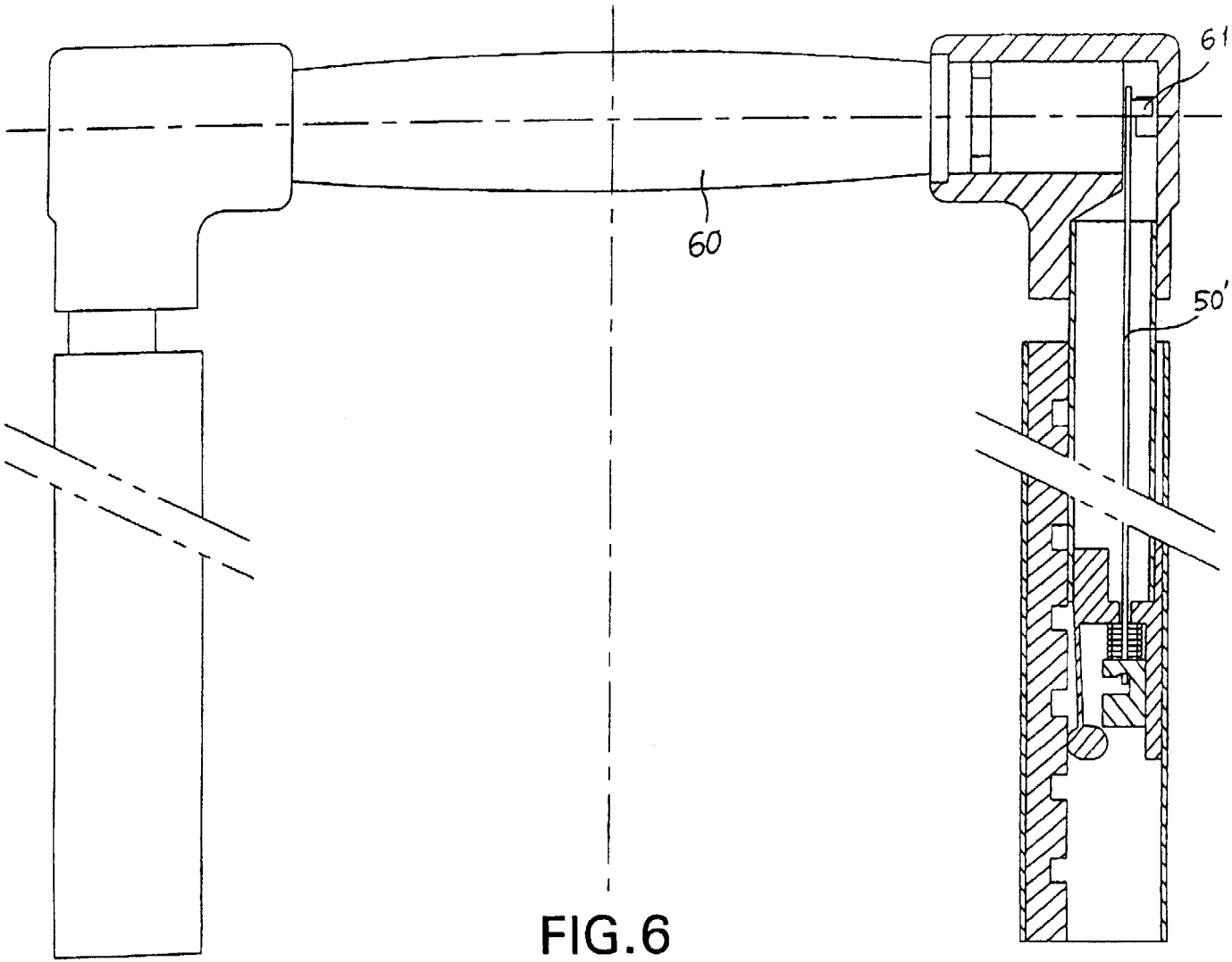
FIG. 6 is an elevational and illustrative view, partly in section, of the retractable handle assembly of the embodiment when in a unlocked position.

Another embodiment of the present invention of the actuating means is shown in FIGS. 4–6, the middle portion of the handle is a rotatable shaft 60 and has two ends, each of the two ends having a second stud 61 eccentrically longitudinally extending therefrom for the first loop 52' of the rod 50' corresponding thereto to be connected thereto. Therefore, when the user operates an actuating means 20' of the embodiment, he/she rotates the rotates shaft 60 (see FIG. 6) such that the rod 50' is lifted by the rotational movement of the second stud 61.

Accordingly, the present invention provides a retractable handle assembly which is easily to be operated and has a low manufacturing cost, especially, the structure thereof is very simple such that the maintenance of the assembly is simple.

Although the invention has been explained in relation to its preferred embodiment, it is to be understood that many other possible modifications and variations can be made without departing from the spirit and scope of the invention as hereinafter claimed.

What is claimed is:

1. A retractable handle assembly for a suitcase, the assembly comprising:

a handle having a middle portion and two end members, each of said end members having a hole defined in an under side thereof, an actuating means being disposed in said handle;

two outer tubes, each of said outer tubes having an end connected to a corresponding one of said end members of said handle and communicating with an associated said hole, each of said outer tubes having at least two protrusions protruding radially from an inner side thereof such that a recess is defined between said two protrusions:

each of said outer tubes having an inner tube slidably received therein, each of said inner tubes having one end thereof fixedly connected to said corresponding one of said end members of said handle and the other end thereof fixedly connected to a first member, said first member having a top in which another hole is defined, a receiving recess being defined in an under side of said first member by said top, at least one side wall and a flexible plate extending from said under side of said top wherein said flexible plate is located adjacent to one of said two protrusions, said flexible plate having a block connected to a distal end thereof;

two rods each having a first end and a second end, said first end being fixedly connected to said actuating means in said handle and said second end of said rod extending through said another hole of said top corresponding thereto to fixedly connect to a second member received in said receiving recess of said first member, a spring mounted to said rod and disposed between said top of said first member and said second member, said second member located adjacent to said block and pushing said block to contact an inner side of said protrusion of said outer tube.

2. The retractable handle assembly as claimed in claim 1 wherein said actuating means includes a link received in said handle and said link has two ends and each of said ends is connected to said rod corresponding thereto, said handle having a slot defined in an under side thereof so as to receive an actuating member which contacts said link such that said link is lifted upwardly by grasping said handle and said actuating member.

3. The retractable handle assembly as claimed in claim 1 wherein said middle portion of said handle is a rotatable shaft and has two ends, each of said two ends having a second stud eccentrically longitudinally extending therefrom for said first end of said rod corresponding thereto to be connected thereto.

* * * * *